US010898749B2

(12) United States Patent
Ju et al.

(10) Patent No.: US 10,898,749 B2
(45) Date of Patent: Jan. 26, 2021

(54) SPRING-GRIP EASY TO ADJUST GRIP

(71) Applicants: Liuwei Ju, Zhejiang (CN); Baosheng Hu, Zhejiang (CN)

(72) Inventors: Liuwei Ju, Zhejiang (CN); Baosheng Hu, Zhejiang (CN)

( * ) Notice: Subject to any disclaimer, the term of this patent is extended or adjusted under 35 U.S.C. 154(b) by 0 days.

(21) Appl. No.: 16/396,694

(22) Filed: Apr. 28, 2019

(65) Prior Publication Data

US 2020/0338385 A1 Oct. 29, 2020

(51) Int. Cl.

| | |
|---|---|
| ***A63B 21/072*** | (2006.01) |
| ***A63B 21/00*** | (2006.01) |
| ***A63B 23/16*** | (2006.01) |
| ***A63B 21/04*** | (2006.01) |
| ***A63B 21/02*** | (2006.01) |

(52) U.S. Cl.

CPC ..... *A63B 21/00072* (2013.01); *A63B 21/023* (2013.01); *A63B 21/0421* (2013.01); *A63B 21/4035* (2015.10); *A63B 23/16* (2013.01)

(58) Field of Classification Search

CPC ..... A63B 21/00072; A63B 23/16; Y10T 403/32483; Y10T 403/32524; Y10T 403/592; F16B 7/1409; B25G 3/18; B25G 3/20

USPC ..... 482/49; 403/DIG. 6; 81/177.2

See application file for complete search history.

(56) References Cited

U.S. PATENT DOCUMENTS

| | | | | |
|---|---|---|---|---|
| 4,702,474 | A * | 10/1987 | Guibert | A63B 21/0004 482/126 |
| 6,726,393 | B2 * | 4/2004 | Tsai | B25B 15/001 16/110.1 |
| 7,878,094 | B2 * | 2/2011 | Lin | B25G 1/043 403/109.3 |
| 8,196,495 | B2 * | 6/2012 | Chen | B25B 13/06 81/125 |
| 9,700,749 | B2 * | 7/2017 | Carpinelli | A63B 23/16 |
| 10,166,657 | B2 * | 1/2019 | Cummings | B25B 21/02 |
| 2007/0186730 | A1 * | 8/2007 | Chen | B25B 13/461 81/177.2 |
| 2020/0121985 | A1 * | 4/2020 | Ju | A63B 23/16 |

* cited by examiner

*Primary Examiner* — Joshua T Kennedy

(57) ABSTRACT

A spring-grip easy to adjust grip, comprising a torsional spring and two handles for inserting torsion arms of the torsional spring, wherein spacing blind holes are punched on the torsion arm; the handles comprise a fixed handle, a movable handle, a collar, a spring and a limit steel ball, the fixed handle and the movable handle are both hollow tubular structures, compared to the prior art, the invention is provided with different inner diameter segments in the movable handle to realize the limit steel ball having two states of tension and looseness in truncated-cone through hole, thereby realizing the torsion arm having two states of fixation or movable adjustment in handles, which makes grip adjustment method easier, simultaneously, spacing blind holes are labeled with different grip values, which can intuitively determine the grip when using different spacing blind holes, and scientifically guide the grip exercise.

3 Claims, 2 Drawing Sheets

SPRING-GRIP EASY TO ADJUST GRIP

BACKGROUND OF THE INVENTION

1. Field of the Invention

The invention relates to the technical field of sports and fitness equipment, in particular to a spring-grip easy to adjust grip.

2. Background Art

The abdominal spring-grip is a conventional fitness equipment for exercising grip strength, the structure thereof generally comprises a torsional spring and two handles used for inserting torsion arms, a spacing piece is provided close to a collar, and a through hole is provided on both two ends of the spacing piece, two torsion arms of the torsional spring protrudes through the through holes to change the position of the spacing piece and the collar and change the maximum deflection of the torsional spring, thereby changing the grip of the spring-grip, however, the adjustment range of the grip in this way is small, the grip strength has no quantitative reference and the adjustment mode is relatively extensive.

SUMMARY OF THE INVENTION

In view of the defects in the prior art, the invention provides a spring-grip which has a wider adjustment range, simple operation during adjustment and quantifiable grip strength. In order to achieve the object of the invention, the following technical schemes are proposed:

A spring-grip easy to adjust grip, comprising a torsional spring and two handles used for inserting torsion arms of the torsional spring, wherein spacing blind holes are punched on the torsion arm; the handles comprise a fixed handle, a movable handle, a collar, a spring and a limit steel ball, wherein the fixed handle and the movable handle are both hollow tubular structures, the movable handle is sleeved on an upper end of the fixed handle, a limit groove is provided around an outer surface of the upper end of the fixed handle, and the collar is sleeved in the limit groove; a truncated-cone through hole is provided on the fixed handle and below the limit groove, and an outer basal diameter of the truncated-cone through hole is larger than an inner basal diameter thereof; the diameter of the limit steel ball is between the outer basal diameter and the inner basal diameter of the truncated-cone through hole, the limit steel ball is mounted in the truncated-cone through hole, thereby the limit steel ball may protrude a part from an inner underside of the truncated-cone through hole but not pass through the truncated-cone through hole, the diameter of the limit steel ball is larger than a tube wall thickness of the fixed handle, and after the limit steel ball is mounted, a protruding portion is formed on an inner and outer surfaces of the fixed handle pipe wall, and the protruding portion inside the fixed handle tube wall may cooperate with the spacing blind holes on the torsion arm for fixing the torsion arm; an inner middle part of the movable handle is provided with a step protrusion, an inner diameter of the step protrusion is equal to an upper outer diameter of the fixed handle with the addition of the height of the limit steel ball protruding from the outer surface of the fixed handle after close mounting, when the limit steel ball is abutted against the step protrusion, the limit steel ball is stuck in the truncated-cone through hole to limit the position of the torsion arm; an outer diameter of the collar is larger than the inner diameter of the step protrusion and smaller than an upper inner diameter of the movable handle to avoid the movable handle detaching from the fixed handle; an upper end of the spring is abutted against the step protrusion in the movable handle and a lower end of the spring is abutted against an upper part of the fixed handle, when the spring is pressed downwards, the fixed handle relatively moves upwards to drive the limit steel ball to move upwards, leave the step protrusion and move towards an upper part of the movable handle, the limit steel ball has loose space for the upper inner diameter of the movable handle is larger, therefore the torsion arm can be pulled out or pressed inward to adjust the length of the torsion arm inserting into the handles, after adjustment, the limit steel ball is automatically moved to the step protrusion under the resilience of the spring to fix the limit steel ball, thereby achieving the purpose of adjusting grip strength of the spring-grip.

Preferably, the number of the spacing blind holes is 2-5, and each of the spacing blind holes is labeled with a corresponding grip value, which can intuitively determine the grip when using different spacing blind holes, and more scientifically guide the grip exercise.

Preferably, the torsion arm is provided as flat form to facilitate the punching of the spacing blind holes.

Compared to the prior art, the spring-grip easy to adjust grip in the invention, is provided with different inner diameter segments in the movable handle to realize the limit steel ball having two states of tension and looseness in the truncated-cone through hole, thereby realizing the torsion arm having two states of fixation or movable adjustment in the handles, which makes the method of grip adjustment easier, simultaneously, the spacing blind holes are labeled with different grip values, which can intuitively determine the grip when using different spacing blind holes, and more scientifically guide the grip exercise.

DESCRIPTION OF THE PREFERRED EMBODIMENTS

Figure 1:
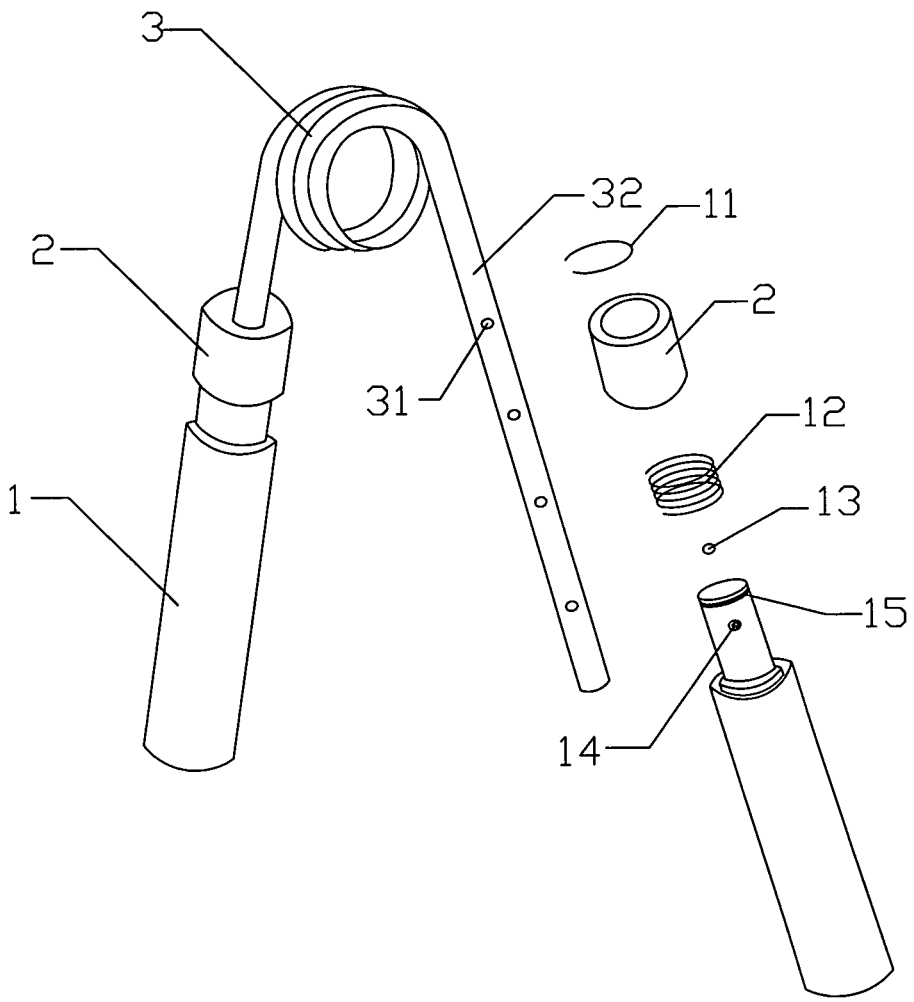
FIG. 1 is the structure diagram of the invention.
Figure 2:
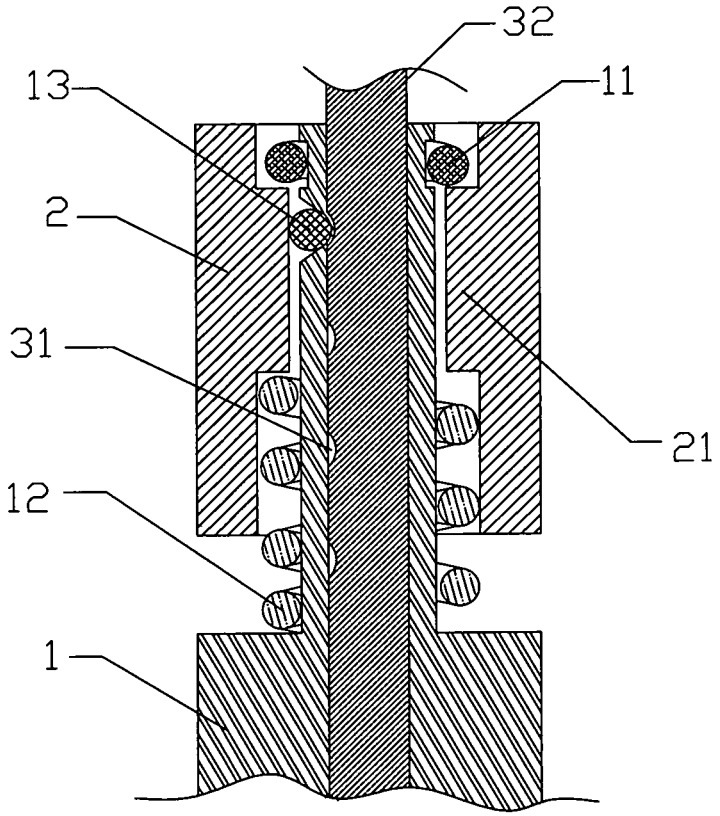
FIG. 2 is the part sectioned view of the invention.

As shown in the embodiments in FIG. 1 and FIG. 2, a spring-grip easy to adjust grip of the invention, comprising a torsional spring 3 and handles, torsion arms 32 of the torsional spring 3 are provided as flat form and punched with four spacing blind holes 31, each of the spacing blind holes 31 is labeled with a corresponding grip value. The handles comprise a fixed handle 1, a movable handle 2, a collar 11, a spring 12 and a limit steel ball 13, wherein the fixed handle 1 and the movable handle 2 are both hollow tubular structures, the movable handle 2 is sleeved on an upper end of the fixed handle 1, a limit groove 15 is provided around an outer surface of the upper end of the fixed handle 1, and the collar 11 is sleeved in the limit groove 15; a truncated-cone through hole 14 is provided on the fixed handle 1 and below the limit groove 15, and an outer basal diameter of the truncated-cone through hole 15 is larger than an inner basal diameter thereof. The diameter of the limit steel ball 13 is between the outer basal diameter and the inner basal diameter of the truncated-cone through hole 14, the limit steel ball 13 is mounted in the truncated-cone through hole 14, thereby the limit steel ball 13 may protrude a part from an inner underside of the truncated-cone through hole 14 but not pass through the truncated-cone through hole 14, the diameter of the limit steel ball 13 is larger than a tube wall thickness of the fixed handle 1, and after the limit steel ball 13 is mounted, a protruding portion is formed on an inner and outer surfaces of the fixed handle 1 pipe wall, and the protruding portion inside the fixed handle 1 tube wall may cooperate with the spacing blind holes 31 on the torsion arm 32 for fixing the torsion arm 32; an inner middle part of the movable handle 2 is provided with a step protrusion 21, an inner diameter of the step protrusion 21 is equal to an upper outer diameter of the fixed handle 1 with the addition of the height of the limit steel ball 13 protruding from the outer surface of the fixed handle after close mounting, when the limit steel ball 13 is abutted against the step protrusion 12, the limit steel ball 13 is stuck in the truncated-cone through hole 14 to limit the position of the torsion arm 32; wherein an outer diameter of the collar 12 is larger than the inner diameter of the step protrusion 21 and smaller than an upper inner diameter of the movable handle 2 to avoid the movable handle 2 detaching from the fixed handle 1; an upper end of the spring 12 is abutted against the step protrusion 21 in the movable handle 2 and a lower end of the spring 12 is abutted against an upper part of the fixed handle 1, when the spring 12 is pressed downwards, the fixed handle 1 relatively moves upwards to drive the limit steel ball 13 to move upwards, leave the step protrusion 21 and move towards an upper part of the movable handle 2, the limit steel ball 13 has loose space for the upper inner diameter of the movable handle 2 is larger, therefore the torsion arm 32 can be pulled out or pressed inward to adjust the length of the torsion arm 32 inserting into the handles, after adjustment, the limit steel ball 13 is automatically moved to the step protrusion 21 under the resilience of the spring 12 to fix the limit steel ball 13, thereby achieving the purpose of adjusting grip strength of the spring-grip. For the limit steel ball 13 has two states of tension and looseness in the truncated-cone through hole 14, thereby realizing that the torsion arm 32 has two states of fixation or movable adjustment in the handles, which makes the method of grip adjustment easier.

The invention claimed is:

1. An adjustable spring grip, comprising:

a torsional spring having a first and a second torsion arm, wherein spacing blind holes are punched along a length of each of the first and second torsion arms;

two handle assemblies receiving the first and second torsion arms, respectively each of the handle assemblies comprising:

a fixed handle, a movable handle, a collar, a spring, and a limit steel ball having a diameter, wherein the fixed handle and the movable handle are both hollow tubular structures, the movable handle is sleeved on an upper end of the fixed handle, a limit groove is provided around an outer surface of the upper end of the fixed handle, and the collar is sleeved in the limit groove;

a truncated-cone through hole is provided on the fixed handle below the limit groove, and an outer basal diameter of the truncated-cone through hole is larger than go inner basal diameter thereof, the diameter of the limit steel ball has a magnitude between the outer basal diameter and the inner basal diameter of the truncated-cone through hole, the limit steel ball is mounted in the truncated-cone through hole, thereby the limit steel ball may protrude from an inner underside of the truncated-cone through hole but not pass through the truncated-cone through hole, the diameter of the limit steel ball is larger than a tube wall thickness of the fixed handle, and after the limit steel ball is mounted, a protruding portion of the limit steel hall is formed on inner and outer surfaces of the fixed handle pipe wall such that protruding portion inside the fixed handle tube wall may cooperate with the spacing blind holes on the torsion arm for fixing the torsion arm;

an inner middle part of the movable handle is provided with a step protrusion, an inner diameter of the step protrusion is equal to an upper outer diameter of the fixed handle with the addition of the height of the limit steel ball protruding from the outer surface of the fixed handle after close mounting, an outer diameter of the collar is larger than the inner diameter of the step protrusion and smaller than an upper inner diameter of the movable handle, an upper end of the spring is abutted against the step protrusion in the movable handle and a lower end of the spring is abutted against an upper part of the fixed handle, when the spring is compressed, the fixed handle relatively moves upwards to drive the limit steel ball to move upwards, disengaging the step protrusion, and move towards an upper part of the movable handle to allow translation of the handle assemblies relative to the torsion arms to adjust grip strength required to flex the torsional spring.

2. An adjustable spring-grip of claim 1, wherein the number of the spacing blind holes is between 2 and 5 spacing blind holes, and each of the spacing blind holes is labeled with a corresponding grip value.

3. An adjustable spring-grip of claim 1, wherein the torsion arms are flat to facilitate punching of the spacing blind holes.

* * * * *